US005421698A

United States Patent [19]

Neri et al.

[11] Patent Number: 5,421,698

[45] Date of Patent: Jun. 6, 1995

[54] DEVICE FOR COMPACTING STACKS OF DIE-CUTS AND CORRECTING THEIR POSITION ON A RELATIVE FEEDER

[75] Inventors: Armando Neri, Bologna; Mario Turra, Casalecchio di Reno, both of Italy

[73] Assignee: G.D S.p.A., Bologna, Italy

[21] Appl. No.: 178,440

[22] Filed: Jan. 6, 1994

Related U.S. Application Data

[63] Continuation of Ser. No. 882,511, May 13, 1992, abandoned.

[30] Foreign Application Priority Data

May 17, 1991 [IT] Italy ..... B091A0161

[51] Int. Cl.[6] ..... B65G 57/00; B65H 31/34

[52] U.S. Cl. ..... 414/788.9; 414/790; 414/789.1; 414/608; 193/35 R

[58] Field of Search ..... 414/491–493, 414/497, 509, 529, 621–622, 532, 788.9, 789.1, 790, 790.1, 790.2, 790.7, 790.8, 795.7, 785, 907, 608; 193/35 R

[56] References Cited

U.S. PATENT DOCUMENTS

| | | | |
|---|---|---|---|
| 2,128,316 | 8/1938 | Paul | 414/789.1 |
| 2,585,076 | 2/1952 | Bandura et al. | 414/794.4 |
| 2,606,483 | 8/1952 | Forbes, Jr. | 414/790.8 |
| 3,231,100 | 1/1966 | Faeber | 414/790.8 |
| 3,374,902 | 3/1968 | Mills | 414/790 |
| 3,545,632 | 12/1970 | Cooper | 414/790 |
| 3,690,485 | 9/1972 | Fischer et al. | 414/529 |
| 4,592,692 | 6/1986 | Suizu et al. | 414/626 |
| 4,652,197 | 3/1987 | Littleton | 414/790.8 |
| 4,764,074 | 8/1988 | Postigo | 414/789.1 |
| 5,088,877 | 2/1992 | Henk | 414/790 |

*Primary Examiner*—Michael S. Huppert
*Assistant Examiner*—R. B. Johnson
*Attorney, Agent, or Firm*—Cushman Darby & Cushman

[57] ABSTRACT

In a device for compacting stacks of die-cuts and correcting their position on a conveyor-feeder with at least one belt, the single stacks are supported and elevated by a structure operating directly adjacent to the belt and affording a surface which ensures stable support to the stack while offering minimal resistance to the movements occasioned in positioning; the compacting action is produced by pairs of moving plates which flank the supporting and elevating station on all sides and impinge on the vertical faces of the stack in directions coinciding with the transverse and longitudinal axes of the belt.

3 Claims, 2 Drawing Sheets

4
5
6
17a
17b
16a
4a
10
20
21
190
210
22
2
23
9
230

16b
40
13
6
20
190
19
17b
200
21
210
8
22
14
180
23
17a
4a
9
18
230

DEVICE FOR COMPACTING STACKS OF DIE-CUTS AND CORRECTING THEIR POSITION ON A RELATIVE FEEDER

This is a continuation of application Ser. No. 07/882,511, filed on May 13, 1992, which was abandoned upon the filing hereof.

BACKGROUND OF THE INVENTION

The present invention relates to a device for compacting stacks of die-cuts and correcting their position on a relative feeder, and in particular, an automatic device capable of compacting and correctly orientating stacks of die-cuts carried on conveyor-feeder systems utilizing broad or narrow belts.

It is in fact well known that when stacked die-cuts are deposited on a feeder, for example by means of suitable forks, the single pieces inevitably become disarranged, slipping one in relation to another and assuming random and irregular positions on the belts carrying them to successive work stations.

SUMMARY OF THE INVENTION

The object of the present invention is to provide a device, designed for association with a belt type conveyor, such as will be capable automatically of correcting the mutual positions of the die-cuts in each stack by compaction and bringing about their faultless vertical alignment, also of repositioning a stack in such a way as to ensure it is correctly placed on the belts before entering a successive work station.

The stated object is realized, according to the invention, in a device for compacting stacks of die-cuts and correcting their position on a feeder comprising at least one looped conveyor belt. The device disclosed comprises first means by which to support a stack, occupying and operating in a position near to the belt and serving to establish a surface such as will afford stable support to a stack when elevated from the belt while offering minimal resistance to any movement of the stack by virtue of the low coefficient of friction existing between the first means and the base of the stack; such a device also comprises second means, disposed and operating peripherally around the supporting and elevating means, serving to effect a compaction of the stack both in the transverse direction and in the longitudinal direction of the belt.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
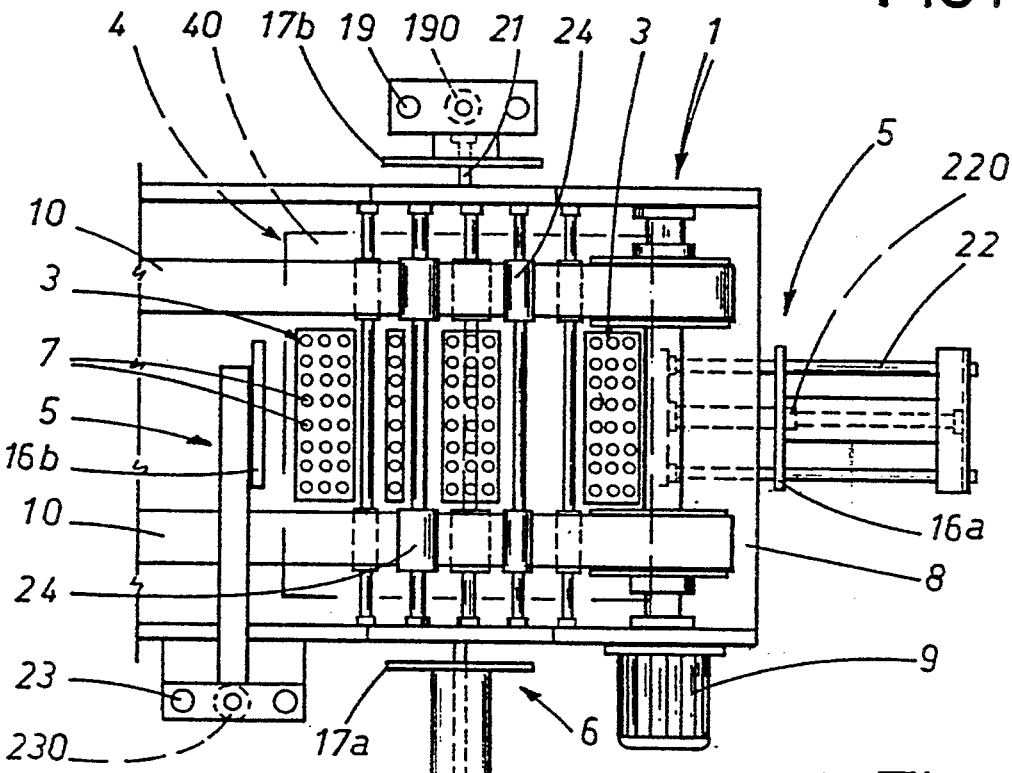
FIG. 1 is the schematic plan view of a device embodied according to the present invention.

The device according to the invention, denoted 1 in its entirety in FIG. 1, serves to compact stacks of die-cuts and correct their position on a relative feeder; such a device is suitable for association with a narrow or wide belt type conveyor-feeder, denoted 10, carried by a supporting frame 8. The conveyor-feeder 10 comprises preferably two timing belts, similarly denoted 10 throughout, looped around respective transmission pulleys 11 (the two pulleys 11 visible in the drawings are power driven by a motor 9), and passing around further idle pulleys 24 arranged in such a way (see FIG. 2) as to create two gaps, denoted 12, coinciding with two corresponding breaks in continuity of the conveying surface afforded by the belts 10. The gaps 12 are spaced apart at a distance matching the distance between centers of the prongs of a fork device (not illustrated) capable of movement in a direction normal to the conveying direction of the feeder, by which stacks 4 of die-cuts 40 are deposited on the belts 10.

The device 1 comprises first means, denoted 2, and second means 5 and 6, all carried by the frame 8, by which the stack 4 is respectively supported and compacted.

The support means 2 are stationed to operate in a position near to the feeder, and more exactly, in the case of the embodiment illustrated, within the space lying between the two belts 10. Likewise in the example of the drawings, the support means 2 are capable of ascending and descending movement between two limit positions: a lowered at-rest position, below the level of the working surfaces of the belts 10, and a raised operating position in which the stack 4 of die-cuts is lifted clear of the belts; thus, the support means 2 may be defined also as supporting and elevating means.

Figure 2:
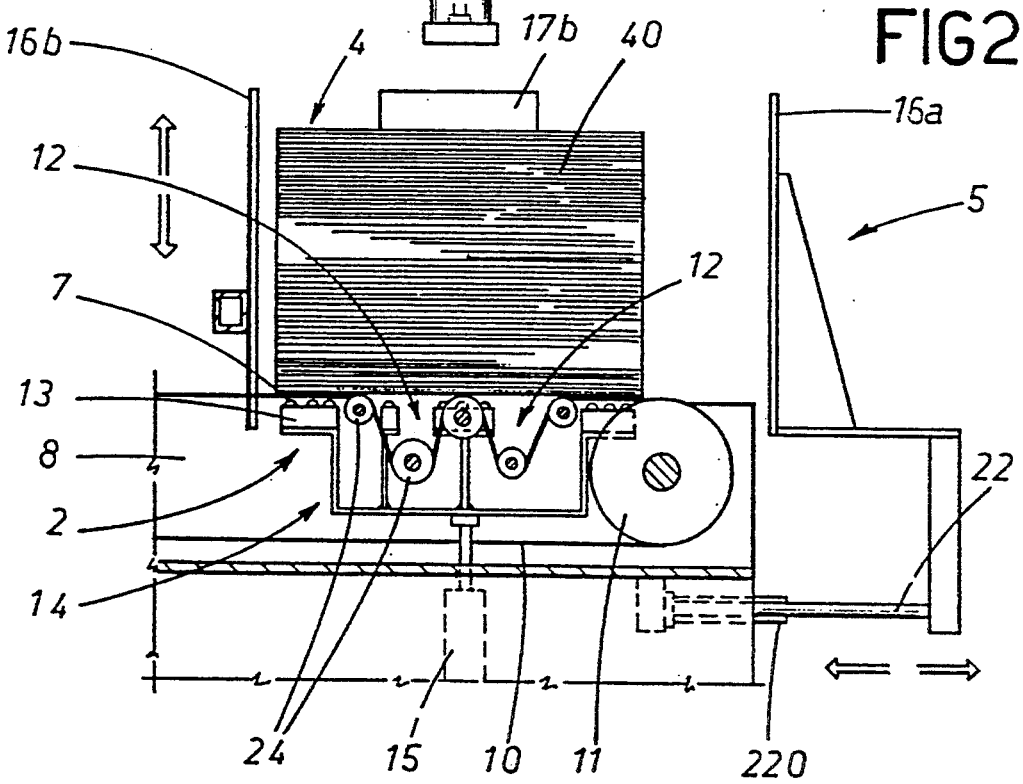
FIG. 2 is a side elevation of the device of FIG. 1, with certain parts omitted better to reveal others.
Figure 4:
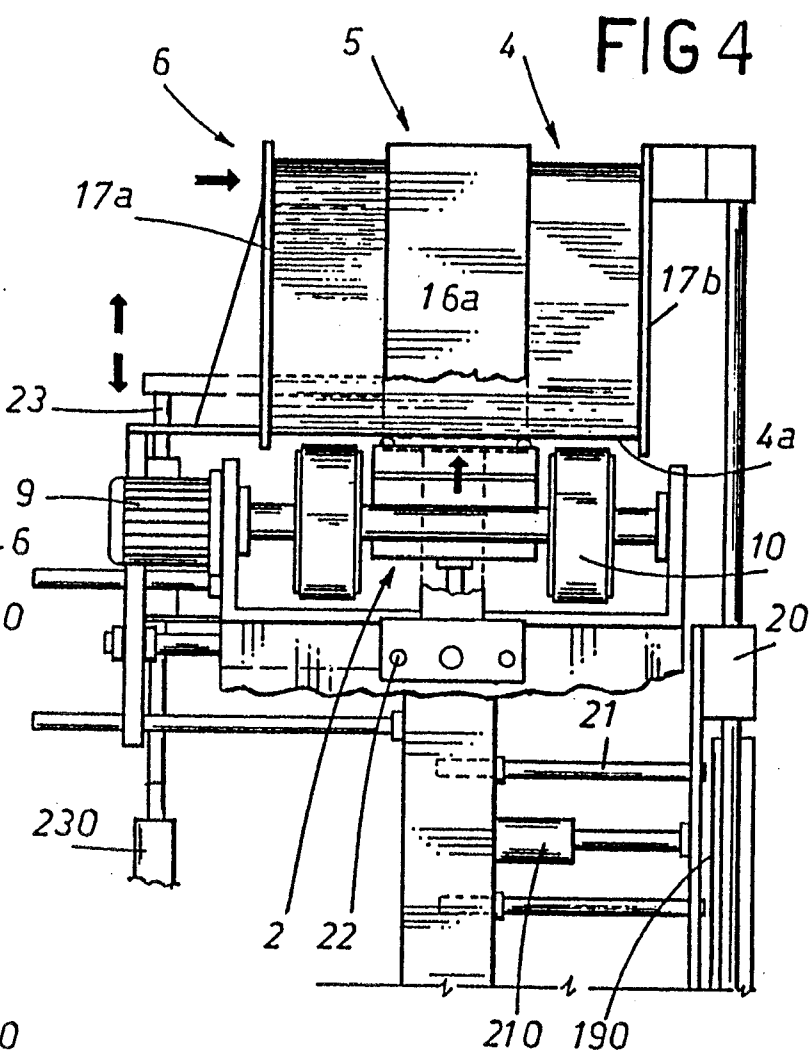
FIGS. 3 and 4 show the device of FIG. 1 in elevation from the rear, with certain parts omitted or cut away better to reveal others, occupying a receiving position and an operating position, respectively.
Figure 3:
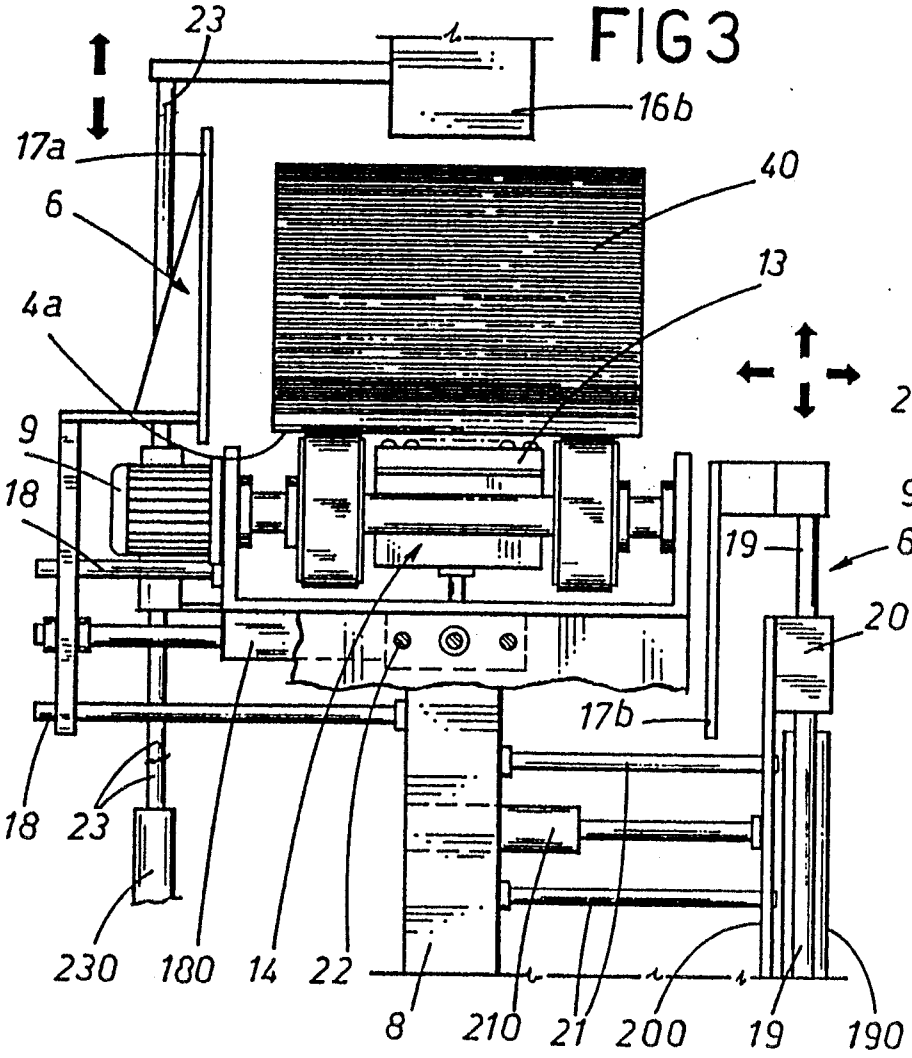

The supporting and elevating means 2 thus serve to establish a bearing surface 3, which exhibits two breaks in continuity coinciding exactly with the two gaps 12, and are embodied in such a way as to minimize friction between this same surface 3 and the base 4*a* of the stack 4; the latter purpose is achieved in the example illustrated by embodying the surface 3 as a plurality of balls 7 associated with the uppermost section of the support means 2 (see FIGS. 2, 3 and 4). The balls 7 are retained captive in respective flat elements 13 carried by a branched structure 14 that is capable of ascending and descending movement:, brought about by respective actuator means 15 (e.g. a fluid power cylinder), between two limit positions in which the supporting surface 3 lies respectively below the top branches of the belts 10 (FIGS. 2 and 3) and above (FIG. 4). The compacting means 5 and 6 will be seen in FIG. 1 to comprise two pairs of vertical plates 16*a*, 16*b* and 17*a*, 17*b*, each pair disposed parallel one with another, the one pair lying parallel and the other pair transverse to the longitudinal or conveying direction of the belts 10. At least one plate of each pair is capable of translatory motion, and at least one of the four plates 16*a*, 16*b*, 17*a*, 17*b* is capable of ascending and descending movement. The longitudinally disposed plates 17*a* and 17*b*, which apply a transverse compacting action, are disposed on opposite sides of the belts 10 and capable of movement toward and away from one another. One of the plates of this same pair, that denoted 17*b*, is also capable of ascending and descending movement between a raised position, and a lowered position fully below the lowest point of the gaps 12 in the belts 10, in such a way that the gaps are able to admit a fork approaching from one side carrying a stack 4 of die-cuts 40.

As discernible from FIGS. 1 and 3, the longitudinal plate 17*a* capable only of horizontal movement is associated permanently with a pair of support and guide rods 18 carried by and axially slidable in relation to the frame 8. The relative horizontal movement is produced by a fluid power cylinder 180. The ascending and descending longitudinal plate 17*b* is associated permanently with vertically disposed parallel guide and support rods 19 carried by and axially slidable in a block 20 associated rigidly with a connecting plate 200, rigidly associated in its turn with horizontal parallel guide and support rods 21 carried by and axially slidable in relation to the frame 8. Vertical and horizontal movement of the plate 17*b* is brought about by respective fluid power cylinders 190 and 210 disposed parallel to the corresponding rods 19 and 21 (see FIG. 3). The plates 16*a* and 16*b* disposed transversely to the belts 10, by which the stack 4 is compacted in the longitudinal direction, are carried by respective horizontally and vertically disposed parallel guide rods 22 and 23; the plate 16*a* to the rear of the stack (in relation to the conveying direction of the belts 10) is carried by the horizontal rods 22, and the plate 16*b* lying forward of the stack by the vertical rods 23, as illustrated in FIGS. 1 and 3. The forwardmost plate 16*b* is capable of ascending and descending movement between a lowered limit position, in which it functions as a reference against which to direct the stack 4 of die-cuts 40, and a raised limit position in which it lies beyond the dimensional compass of the stack 4, affording passage to the stack when distanced ultimately from the support means 2 by the belts 10.

It will be clear that the plate 16*b* in question has necessarily to be capable of vertical movement; indeed in the event of the stack 4 of die-cuts 40 being deposited on the belts from above, this would be the only plate of which vertical movement is required. Where the stack 4 approaches the belts through a horizontal direction, however, carried by a loading fork (not illustrated), one of the two longitudinally disposed plates must also be capable of vertical movement to allow the necessary access to the fork, hence the embodiment of the plate denoted 17*b* as shown in the accompanying drawings. The transverse plates 16*a* and 16*b* are invested with movement by respective fluid power cylinders 220 and 230.

The various fluid power cylinders illustrated in the drawings, together with sensing means neither described nor illustrated (being conventional in embodiment) but forming an integral part of the device 1, are connected and/or interlocked to a central control unit (not illustrated) capable of governing the operation of the entire device 1. Observing the accompanying drawings, it will be seen that an at-rest configuration of the device 1 is established with the supporting and elevating means 2 at standstill in the lowered position, the forwardmost plate 16*b* at standstill in the raised position, as shown in FIG. 3, the plates denoted 16*a* and 17*a* at standstill distanced from the belts 10, and the remaining plate 17*b* at standstill in the lowered position, also distanced from the belts 10, as in FIG. 3. The moment a stack 4 of die-cuts 40 has been set down on the belts 10 and the fork or other mechanism withdrawn, the balls 7 will be elevated by the respective fluid power cylinder 15 and brought into contact with the base 4*a* of the stack 4, thereby lifting the die-cuts 40 clear of the belts 10 (as in FIG. 4).

Resting thus freely on the support means 2, the stack 4 is invested easily with movement by virtue of the interfacing balls 7.

Having lowered the forwardmost plate 16*b* and raised the longitudinal plate 17*b* by means of the relative cylinders 230 and 190, the cylinders denoted 180, 210 and 220 are activated to draw the longitudinal plates 17*a* and 17*b* one toward the other, and the rear plate 16*a* toward the forward plate 16*b*. As a result, any die-cuts 40 in the stack 4 not entirely in alignment with the remainder are compacted into place, and at the same time, the stack 4 as a whole can be straightened substantially about a vertical axis so as to assume the required correct position. Thereafter, the forwardmost plate 16*b* is raised and the rear plate 16*a* distanced from the stack 4, the longitudinal plates 17*a* and 17*b* are drawn apart, and the access plate 17*b* is lowered. The supporting and elevating means 2 are now lowered to resettle the stack 4 on the belts 10, whereupon the belts are set in motion and the compacted and correctly positioned stack is conveyed toward a successive work station, passing beneath the raised plate 16*b*. The reason for raising the forward plate 16*b* before the longitudinal plates 17*a* and 17*b* are drawn apart is that the latter plates continue to restrain the stack 4 and thus prevent the die-cuts 40, still in contact with the transverse forward plate 16*b*, from being disturbed by the lifting movement.

In the example of the drawings, the die-cuts 40 making up the stacks 4 are essentially rectangular and the plates 16*a*, 16*b* and 17*a*, 17*b* appear flat; naturally enough, the die-cuts 40 might well be of other outline and the plates accordingly of shape to match, without prejudice to the scope of the present invention.

Similarly, the supporting and elevating means 2 might be fixed, with the pulleys 11 and belt 10 capable of ascending and descending motion.

What is claimed is:

1. A device for compacting and conveying a vertical stack of horizontally extending die cuts for correcting positioning of said die cuts and said stack, said device comprising:

a frame;

a conveyor-feeder which includes at least two conveyor belts, each looped around a respective horizontal axis and presenting a general horizontal support surface arranged for transporting said stack longitudinally of said conveyor-feeder, said rolls being supported on said frame;

means cooperable with said belts at a compacting station for permitting tines of a forklift to deposit said stack onto said belts without interference with operation of said conveyor-feeder:

means disposed on said frame between said belts at said compacting station for temporarily elevating said stack by engagement with an underside of a lowermost element of said stack and supporting said stack above Said belts and thereby temporarily transferring support of said stack from said conveyor-feeder to said elevating and supporting means;

said elevating and supporting means having upwardly acting rollable elements arranged to provide an interface between said elevating and supporting means and said lowermost sheet of said stack to facilitate transverse horizontal shifting of said stack when supported on said elevating and supporting means; and pairs of vertically oriented stack compacting means arranged on said frame to engage said stack at said compacting station from respective opposite sides, for adjusting horizontal positioning of said stack longitudinally and transversely of said belts while said stack is temporarily elevated and supported on said elevating and supporting means; at least one of said stack compacting means in each pair being mounted for horizontal movement towards and away from the respective said stack compacting means in the same said pair; and at least one of said stack compacting means in at least one of said pairs being movable to a non-interfering location in which said stack, while supported on said conveyor feeder, can be transported longitudinally of said belts to or from said compacting station.

2. The device of claim 1, wherein:

said rollable elements comprise balls mounted for rolling contact with said underside of said lowermost element of said stack.

3. The device of claim 1, wherein:

each said stack compacting means comprises a respective plate and supporting means for said plate.

* * * * *